US008443972B1

(12) United States Patent
Pendergraph et al.

(10) Patent No.: US 8,443,972 B1
(45) Date of Patent: May 21, 2013

(54) HANG TAG ASSEMBLY FOR A HOLE SAW

(75) Inventors: Melvin A. Pendergraph, Arlington Heights, IL (US); Crystal Williams, Lansing, IL (US); Arrik Kim, Tolland, CT (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/336,836

(22) Filed: Dec. 23, 2011

(51) Int. Cl.
*B65D 85/00* (2006.01)
*A47F 5/00* (2006.01)
*B23B 51/04* (2006.01)

(52) U.S. Cl.
USPC ..... 206/349; 206/493; 206/806; 248/309.1; 408/204

(58) Field of Classification Search
USPC ..... 206/1.5, 349, 378, 493, 806; 211/70.6; 248/309.1, 314, 909; 294/137, 158; 408/204–209, 238–240
See application file for complete search history.

(56) References Cited

U.S. PATENT DOCUMENTS

| | | | | |
|---|---|---|---|---|
| 3,053,424 | A | 9/1962 | Reinhard | |
| 4,019,632 | A | 4/1977 | Greenlee | |
| 4,199,060 | A * | 4/1980 | Howard | 206/373 |
| 4,415,080 | A | 11/1983 | Romine et al. | |
| 4,702,373 | A | 10/1987 | Meade | |
| 4,784,263 | A | 11/1988 | Stanley | |
| 5,740,911 | A | 4/1998 | Chou | |
| 5,979,652 | A | 11/1999 | Rosler | |
| 5,988,381 | A | 11/1999 | Ling | |
| 6,032,797 | A | 3/2000 | Kao | |
| 6,092,656 | A | 7/2000 | Ernst | |
| 6,161,693 | A | 12/2000 | Findle et al. | |
| 6,241,092 | B1 | 6/2001 | Vasudeva | |
| 6,273,255 | B1 | 8/2001 | Rosler | |
| 6,581,894 | B1 | 6/2003 | Tong | |
| 6,634,501 | B2 | 10/2003 | Su et al. | |
| 6,672,555 | B2 | 1/2004 | Chang | |
| 6,729,468 | B1 | 5/2004 | Dobmeier | |
| 6,746,187 | B2 | 6/2004 | Alm | |
| 6,854,594 | B2 | 2/2005 | Vasudeva et al. | |
| 6,883,664 | B2 | 4/2005 | Lee | |
| 6,935,516 | B2 | 8/2005 | Chiang | |
| 6,986,538 | B1 | 1/2006 | Ecker | |
| 7,210,663 | B2 | 5/2007 | Wheeler et al. | |
| 7,264,213 | B2 | 9/2007 | Liu | |
| 7,287,644 | B2 | 10/2007 | Chen | |
| 7,416,082 | B2 | 8/2008 | Roesler | |
| 7,565,973 | B2 | 7/2009 | Chang | |
| 7,824,137 | B2 * | 11/2010 | Vasudeva et al. | 408/204 |
| 2003/0029748 | A1 | 2/2003 | Hargrave-Thomas | |
| 2006/0284001 | A1 | 12/2006 | Paradise et al. | |
| 2008/0272017 | A1 | 11/2008 | Chang | |
| 2008/0314779 | A1 | 12/2008 | Hu | |
| 2009/0026105 | A1 | 1/2009 | Wu | |
| 2009/0169317 | A1 | 7/2009 | Rae | |

* cited by examiner

*Primary Examiner* — Bryon Gehman
(74) *Attorney, Agent, or Firm* — Maginot, Moore & Beck

(57) ABSTRACT

A method of packaging a hole saw includes positioning a circular cutting edge portion of the hole saw against a surface of a base member of a hang tag assembly. The base member includes a post that extends from the surface into a hollow interior defined by the hole saw. A cap member of the hang tag assembly is positioned adjacent a mounting portion of the hole saw. The cap member includes a stem and a display card portion. The stem is advanced through a bore defined in the mounting portion and into the hollow interior of the hole saw. The post is then secured to the stem within the hollow interior of the hole saw.

16 Claims, 9 Drawing Sheets

HANG TAG ASSEMBLY FOR A HOLE SAW

TECHNICAL FIELD

This invention relates to the hole saws, and particularly to hang tags and display packaging for hole saws.

BACKGROUND

A hole saw is a tool that allows a user to make circular cut-outs in a material such as wood, steel, fiberglass, plastic, etc. Typically, a hole saw comprises a cylindrically shaped body with a circular cutting edge provided at one end of the body. The other end of the cylindrical body includes a mounting portion that defines a bore configured to removably secure the hole saw to an arbor or mandrel of a driving tool, such as a power drill.

Display packages have been developed that enable most types of tools and tool accessories to be displayed in stores by hanging the packaged product on rods or hooks that extend from a wall or display case. These display packages are commonly known as hang or clip tags which are designed to hold the product in a manner that is easily viewable, provide a surface for an identifying label, provide a hanging slot for placing the hang tag on a rod or hook, and retain a security device, such as a Sensormatic tag, to deter theft.

Hang tag packaging for tools and tool accessories is typically designed to retain the tool or tool accessory in a safe manner while leaving as much of the tool or tool accessory exposed or visible for easy viewing by a customer. For example, in displaying tools and tool accessories that have cutting edges, it is a common practice for display packaging to cover the cutting edge in some manner so the cutting edge does not pose a risk to customers or employees. The cylindrical body and circular cutting edge of hole saws, however, has made it difficult for hole saws to be secured to a hang tag in a manner that maximizes visibility of the hole saw while leaving the cutting edge protectively covered. As a result, hole saws are typically packaged in boxes that completely cover the hole saw. While effective, this type of packaging is usually more expensive and takes up more space than hang tag type display packaging.

What is needed is a hang tag assembly for a hole saw that enables a hole saw to be secured to a hang tag in a manner that maximizes exposure of the hole saw while protectively covering the circular cutting edge of the hole saw, and that is inexpensive to manufacture and easy to install.

SUMMARY

In accordance with one embodiment of the present disclosure, a method of packaging a hole saw includes positioning a circular cutting edge portion of the hole saw against a planar surface of a base member of a hang tag assembly. The base member includes a post that extends from the planar surface into a hollow interior defined by the hole saw. A cap member of the hang tag assembly is positioned adjacent a mounting portion of the hole saw. The cap member includes a stem and a display card portion. The stem is advanced through a bore defined in the mounting portion and into the hollow interior of the hole saw. The post is then secured to the stem within the hollow interior of the hole saw.

In accordance with another embodiment of the present disclosure, a hole saw display package includes a hole saw and a hang tag assembly. The hole saw includes a cylindrical body having a cutting edge portion and a mounting portion. The cylindrical body defines a hollow interior, and the mounting portion includes an outer surface that defines a bore for receiving an arbor of a driving tool. The hang tag assembly includes i) a base member having a planar surface and a first linking structure that extends from the planar surface, ii) a cap member having an inner surface and a second linking structure that extends from the inner surface, and iii) a display card portion attached to the cap member. The cutting edge portion of the hole saw is positioned against the planar surface of the base member. The inner surface of the cap member is positioned adjacent the outer surface of the mounting portion. The second linking structure extends through the bore defined in the outer surface and into the hollow interior of the hole saw. The first linking structure is secured to the second linking structure within the hollow interior to affix the cap member to the base member.

In accordance with yet another embodiment, a hang tag assembly for a hole saw includes i) a base member including a planar surface and a first linking structure that extends from the planar surface; ii) a cap member including an inner surface and a second linking structure that extends from the planar surface; and iii) a display card portion attached to the cap member. The display card portion defines a hanging slot. The first linking structure and the second linking structure are configured to be secured to each other to affix the cap member to the base member. The planar surface of the base member is configured to be placed against a circular cutting edge portion of a hole saw. The inner surface of the cap member is configured to be positioned adjacent a mounting portion of the hole saw. The second linking structure is configured to extend through a bore defined by the mounting portion when the inner surface is positioned adjacent the mounting portion of the hole saw. When the planar surface of the base member is positioned adjacent the cutting edge portion of the hole saw and the inner surface of the cap member is positioned adjacent the mounting portion of the hole saw with the second locking structure extended through the bore, the first linking structure and the second linking structure are configured to meet within a hollow interior defined in the hole saw.

DRAWINGS

DESCRIPTION

Figure 1:
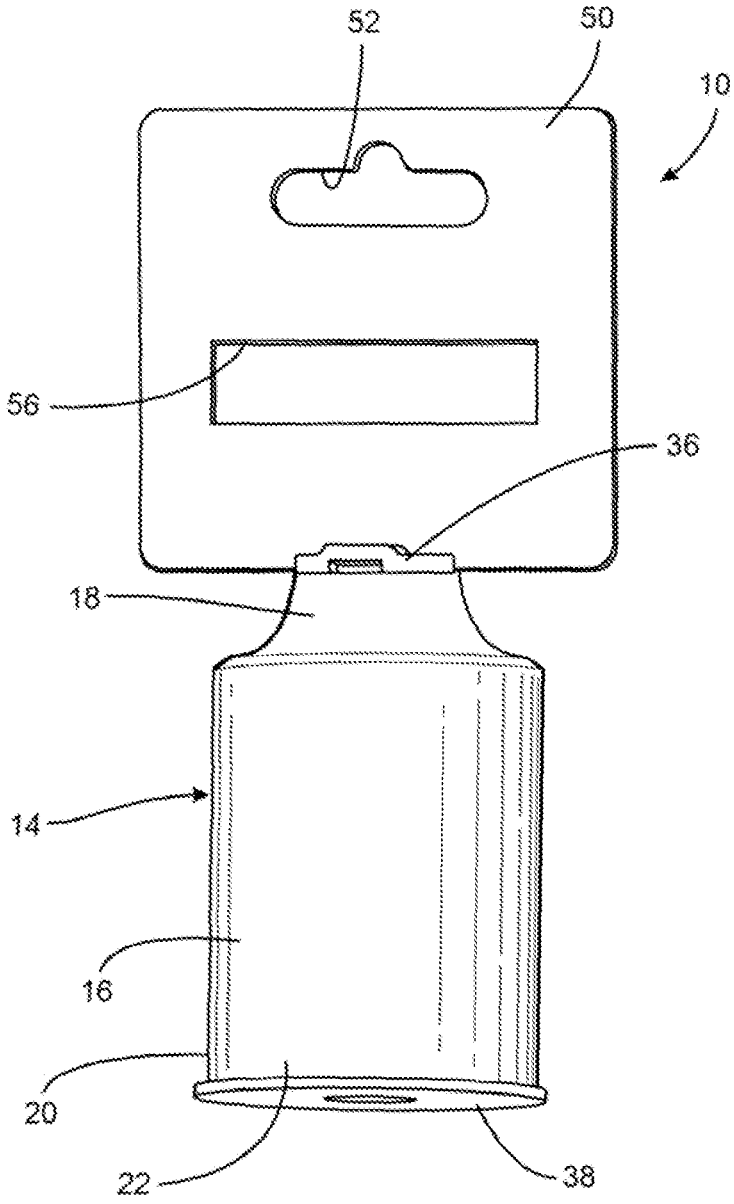
FIG. 1 is a side view of a hang tag assembly and a hole saw with the hole saw secured to the hang tag assembly.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Referring to FIG. 1, a hang tag assembly 10 in accordance with the present disclosure is shown retaining a hole saw 14. As explained below, the hang tag assembly 10 enables the hole saw 14 to be secured to a hang tag in a manner that is not easily removed and that maximizes exposure of the hole saw 14 while protectively covering the circular cutting edge. The hang tag assembly 10 does not require the use of a separate tool for installation on the hole saw 14. Once installed on the hole saw 14, the hang tag assembly 10 cannot be removed without the use of a separate tool or without breaking a component of the hang tag assembly 10.

Figure 2:
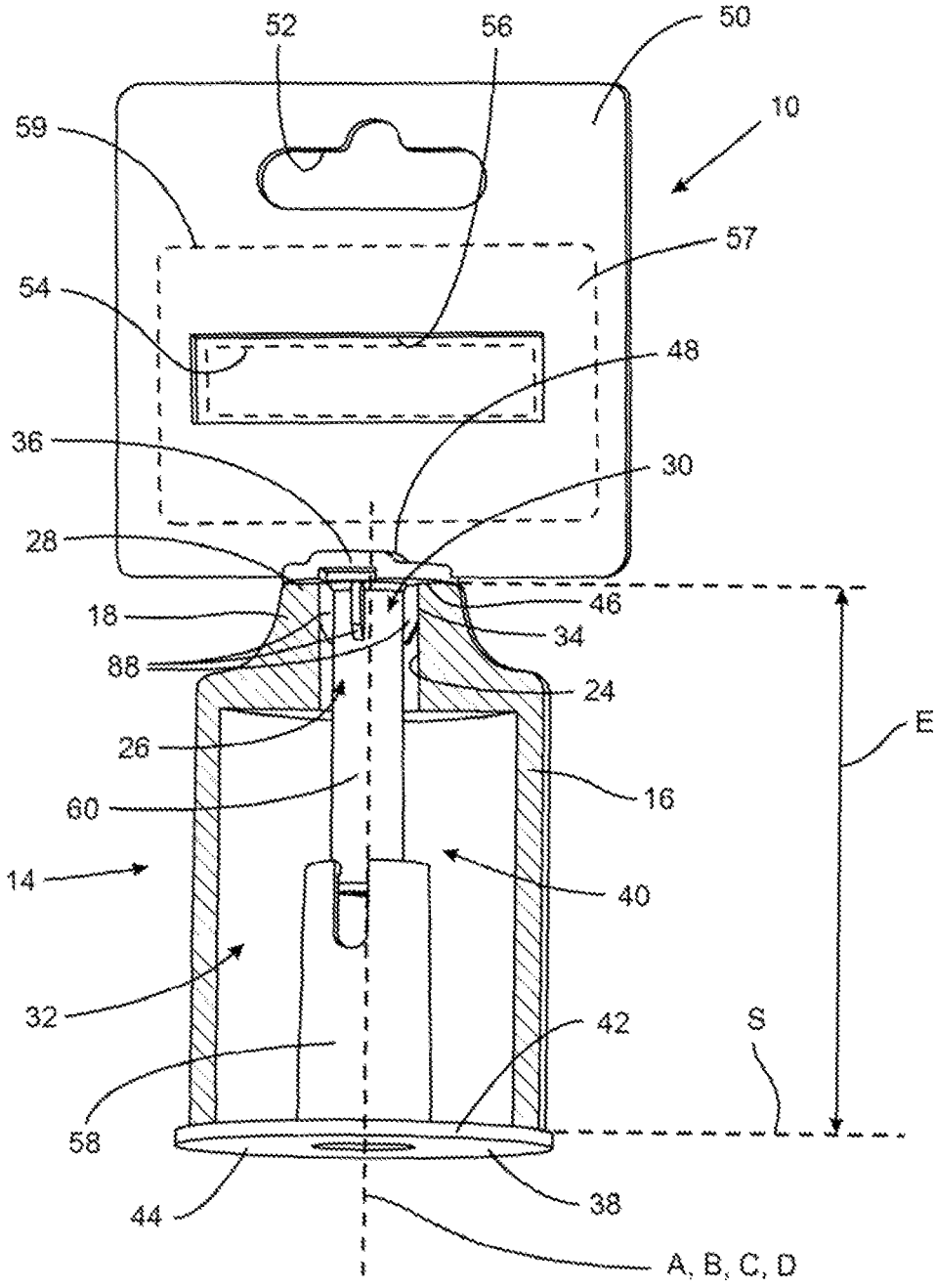
FIG. 2 is a side cross-sectional view of the hang tag assembly and hole saw of FIG. 1.

As depicted in FIGS. 1 and 2, the hole saw 14 comprises a generally cylindrical body 16 that defines an axis A. The body 16 includes a first end portion 18 and a second end portion 20. The first end portion 18 comprises the mounting portion of the hole saw 14 and is configured to secure the hole saw body 16 to an arbor (not shown) of a driving tool (not shown), such as a power drill. The mounting portion 18 is configured to secure the cylindrical body 16 to the arbor of the driving tool with the axis A aligned with the axis of rotation of the arbor.

The second end portion 20 of the cylindrical body 16 comprises the cutting portion of the hole saw 14 and includes a circular cutting edge portion 22 that is centered on the axis A. The circular cutting edge portion 22 resides substantially in a single plane S that is perpendicular to the axis A. The diameter of the cylindrical body 16 and circular cutting edge 22 defines the size of the hole saw 14. Hole saws, such as the hole saw 14, range generally in size from five-eighths of an inch to six inches in diameter although smaller and larger hole saw diameters are possible.

In one embodiment, the cutting edge portion 22 includes a plurality of cutting teeth (not visible). The number, size, and geometry of the teeth can be varied for cutting different materials. In embodiments, slots, or gullets, (not shown) may be formed between the cutting teeth to provide openings for the exit or removal of cutting debris. In other embodiments, the cutting edge 22 may be encrusted with a hard, gritty material, such as diamond or carbide, (not shown) for use in boring holes in materials, such as brick, concrete, glass, and stone.

Referring to FIG. 2, the mounting portion 18 includes an interior wall 24 that defines a bore 26, also referred to as an arbor hole, configured to receive an arbor (not shown) of a driving tool. The mounting portion 18 includes an outer surface 28 that defines an opening 30 into the bore 26. The bore 26 defines a bore axis B. The bore 26 is located in the mounting portion 18 with the bore axis B aligned with the axis of rotation A of the cylindrical body 16. The cylindrical body 16 of the hole saw 14 defines a hollow interior space 32. The bore 26 extends through the mounting portion and opens into the hollow interior space 32.

The bore 26 is configured to receive an arbor of a driving tool. In one embodiment, the interior wall 24 of the bore 26 defines one or more grooves or recesses 34 arranged parallel to the bore axis B. The grooves 34 are configured to receive complementarily configured splines (not shown) provided on the arbor. The grooves and splines cooperate to prevent rotational movement of the hole saw with respect to the arbor. In alternative embodiments, the interior wall 24 can be threaded for meshing engagement with complementary threads (not shown) provided on the arbor (not shown). The arbor for a hole saw is configured to carry a drill bit, or pilot bit, (not shown) for boring a centering hole for the hole saw 14. When the arbor is secured to the hole saw, the pilot bit extends from the arbor in alignment with the axis A through the hollow interior of the hole saw to position the tip of the pilot bit beyond the cutting edge portion 22 of the hole saw 14.

Figure 3:
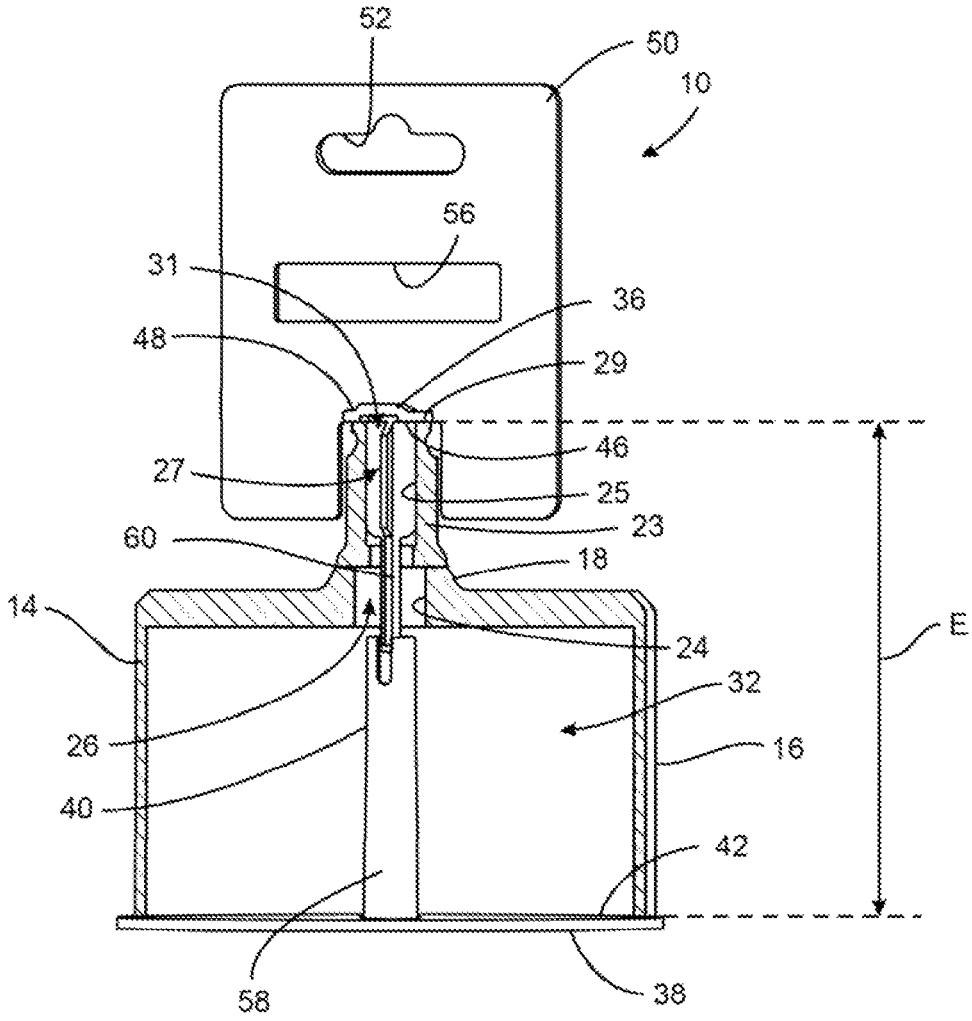
FIG. 3 is a side cross-sectional view of a hang tag assembly, a hole saw, and an adapter with the adapter secured to the hole saw and the hole saw and adapter secured to the hang tag assembly.

In some cases, a hole saw adapter 23 may be used to secure a hole saw 14 to the arbor of a driving tool. Referring to FIG. 3, the adapter 23 comprises a generally cylindrical member having a first end portion adapted to be releasably secured to the mounting portion 28 of the hole saw 14. The second end portion of the adapter is configured to be releasably secured to the arbor of the driving tool. As depicted in FIG. 3, the adapter 23 includes an interior wall 25 that defines a bore 27 that extends through the adapter. The adapter includes an outer surface 29 that defines an opening 31 into the bore 27.

Figure 4:
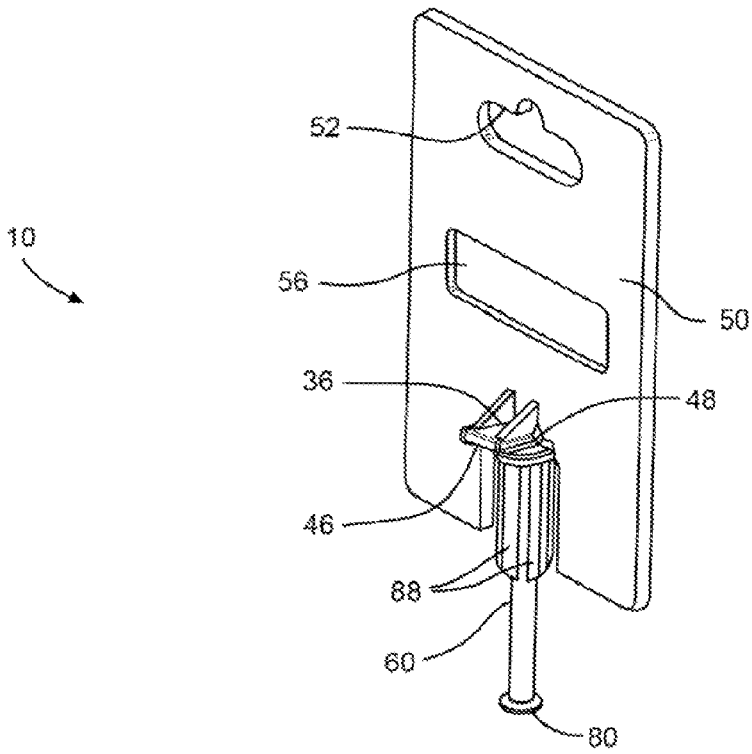
FIG. 4 is a perspective view of a hang tag assembly for a hole saw with the cap member and base member of the hang tag assembly separated.
Figure 4:
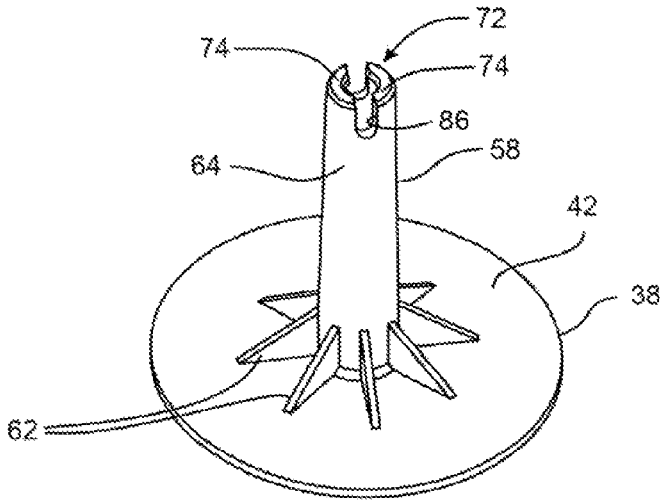
Figure 5:
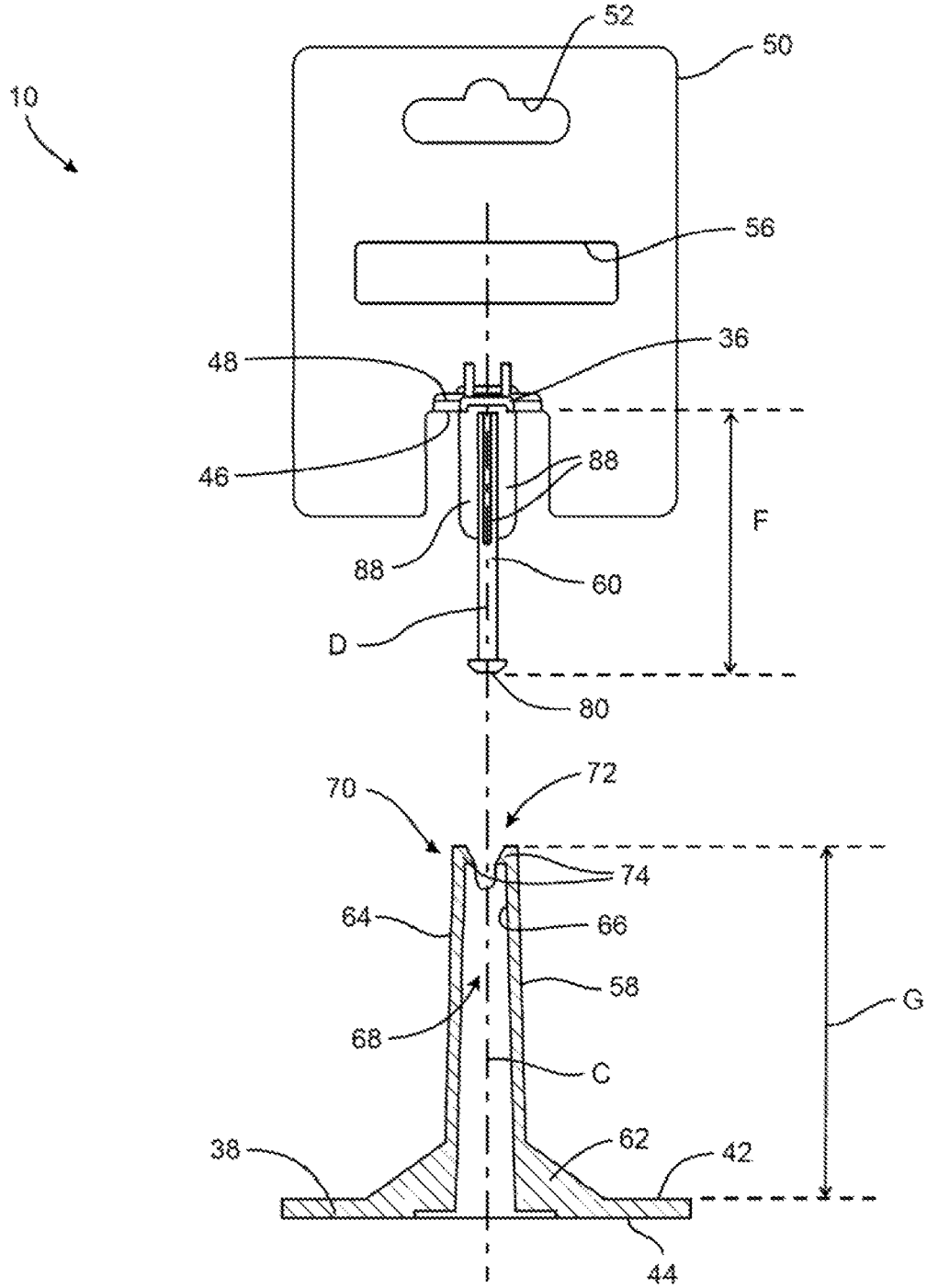
FIG. 5 is a side view of the hang tag assembly of FIG. 4 with the cap member and base member of the hang tag assembly separated.

Referring now to FIGS. 4 and 5, a hang tag assembly 10 for a hole saw 14 has a two-piece construction including a cap member 36 and a base member 38. The cap member 36 and base member 38 are formed of a hard plastic material in an injection molding process. The cap member 36 is positioned adjacent the mounting portion of the hole saw, and the base member 38 is positioned adjacent the cutting edge portion of the hole saw. The cap member 36 and base member 38 are secured to each other by a linking structure 40 that extends through the bore 26 of the mounting portion 18 (and bore 27 of the adapter, if attached) and the hollow interior 32 of the of the hole saw 14 to the base member 38.

The base member 38 of the hang tag assembly 10 includes an inner facing surface 42 and an outer facing surface 44. When the base member 38 is secured to the cap member 36, the inner facing surface 42 is arranged facing toward the cap member 36. The inner facing surface 42 is generally planar so it can sit flush against the circular cutting edge 22 of the hole saw 14 and is sized to enable the inner facing surface 42 to overlap the entire circular cutting edge 22. In the embodiment of FIGS. 4 and 5, the base member 38 has a generally circular shape with a diameter that is slightly greater than the diameter of the circular cutting edge of the hole saw to be secured to the hang tag assembly. In alternative embodiments, the base member 38 can have any shape or size that enables the inner facing surface 42 to substantially cover the cutting edge 22 of the hole saw.

The cap member 36 of the hang tag assembly 10 includes an inner facing surface 46 that faces toward the base member 38 and an outer facing surface 48 faces away from the base member 38. The inner facing surface 42 of the cap member 36 is configured for positioning adjacent the outer surface 28 of the mounting portion 18 of the hole saw 14. The cap member 36 has a size and shape that enables the inner facing surface 42 to overlap substantially the entire opening 30 to the bore defined in the outer surface 28 of the mounting portion 18.

The cap member 36 includes a display card portion 50. The display card portion 50 has a generally planar configuration that defines a hanging slot 52. The hanging slot 52 enables the hang tag assembly 10 (with the hole saw 14 secured thereto) to be supported by a hook (not shown) in a display rack. In one embodiment, the display card portion 50 is formed integrally with the cap member 36. In other embodiments, the display card portion 50 can be formed as a separate component that is affixed to the cap member 36. The hang tag assembly 10 is configured to support the hole saw 14 with the axis A of the hole saw arranged generally parallel to the display card portion 50 although in other embodiments the display card portion 50 can have other orientations with respect to the hole saw. In another alternative embodiment, the display card portion 50 can be incorporated into the base member 38 of the hang tag assembly 10 rather than the cap member 36.

Referring to FIG. 2, the hang tag assembly 10 enables a security device 54, such as a Sensormatic tag, to be incorporated into the package to deter theft from a retail store. In one embodiment, the security device 54 is received in a recess 56 defined in a surface 57 of the display card portion 50. A label 59 is adhered to the surface 57 over the recess 56 to prevent the security device 54 from being easily removed and to conceal the security device 54 from view.

As depicted in FIGS. 2 and 3, the linking structure 40 extends between and connects the inner facing surface 42 of the base member 38 to the inner facing surface 46 of the cap member 36. The linking structure 40 includes a base linking structure 58 and a cap linking structure 60. The base linking structure 58 is provided as an integral component of the base member 38, and the cap linking structure 60 is provided as an integral component of the cap member 36.

The cap linking structure 60 comprises a stem that extends generally perpendicularly from the inner facing surface 46 of the cap member 36. The stem 60 is sized to extend through the bore 26 defined in the mounting portion 18 of the hole saw 14 (FIG. 2) as well as the bore 27 defined in the adapter 23 if the adapter 23 is attached to the hole saw 14 (FIG. 3). When the cap member 36 is positioned over the bore 26 of the hole saw (FIG. 2) or the bore 27 of the adapter 23 (FIG. 3), the stem 60 extends through the bore and into the hollow interior 32 defined by the cylindrical body 16 of the hole saw 14.

The base linking structure 58 of the base member 38 comprises a post or column that extends generally perpendicularly from the inner facing surface 42. When the inner facing surface 42 of the base member 38 is positioned adjacent the circular cutting edge 22 of the hole saw 14, the post 58 is located within the hollow interior 32 of the hole saw 14. As best seen in FIG. 4, the base member 38 includes ribs 62 that extend radially from the post 58 that connect the outer surface 64 of the post 58 to the inner facing surface 42 of the base member 38. The ribs 62 are oriented generally parallel to the post 58 and perpendicular to the inner facing surface 42 of the base member 38 and serve to strengthen the post 58 against bending relative to the base member 38.

Referring to FIG. 5, the stem 60 is configured to extend from the inner facing surface 46 of the cap member 36 a length or distance F, and the post 58 is configured to extend from the inner facing surface 42 of the base member 38 a length or distance G. The distances F, G are selected to enable the post 58 and the stem 60 to meet within the hollow interior 32 of the hole saw 14. The post 58 and the stem 60 of the linking structure 40 are provided with complementarily configured locking features that cooperate to secure the post and stem to each other within the hollow interior 32 of the hole saw 14. In one embodiment, the locking features of the post 58 and stem 60 are configured to have a snap fit engagement with each other to secure the base member 38 and the cap member 36 together.

Figure 6:
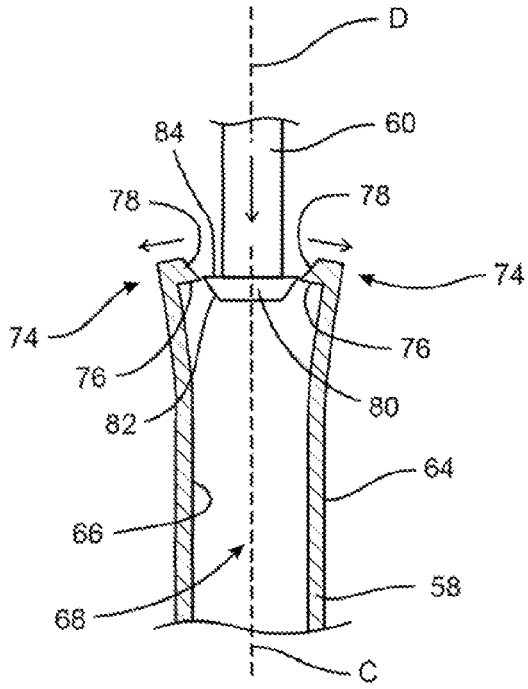
FIG. 6 is a side cross-sectional view of the snap-fit features of the linking structures of the hang tag assembly of FIG. 4 as they are being engaged.
Figure 7:
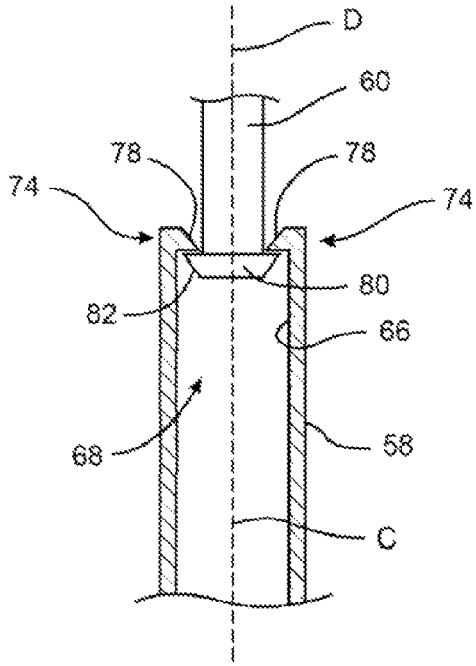
FIG. 7 is a side cross-sectional view of the snap-fit features of the linking structures of the hang tag assembly of FIG. 4 after they are engaged.

As depicted in FIG. 5, the post 58 includes an interior wall 66 that defines a channel 68. The channel 68 defines a channel axis C that is arranged generally parallel to the axis A (FIG. 2) of the hole saw. A distal end portion 70 of the post 58 defines an opening 72 into the channel 68. The distal end portion 70 of the post 58 includes flange structures 74 that extend from the interior wall 66 of the channel 68 toward the channel axis C. The flange structures 74 cause the width of the opening 72 to be smaller than the width or diameter of the channel 68. Referring to FIGS. 6 and 7, the flange structures 74 include locking surfaces 76 that are oriented toward the base member 38. The locking surfaces 76 are arranged substantially perpendicular to the axis C of the channel. The flange structures 74 also include chamfered or beveled surfaces 78 that are oriented away from the base member 38. The chamfered or beveled surfaces 78 at least partially surround and define the opening 72 into the channel 68.

The stem 60 includes a ridge portion 80 having a width or diameter that is greater than the width or diameter of the portions of the stem 60 adjacent the ridge portion 80. As depicted in FIGS. 6 and 7, the ridge portion 80 includes a chamfered or beveled surface 82 that faces generally away from the cap member 36. The ridge portion 80 also includes a locking surface 84 that faces toward the cap member 36 and is oriented substantially perpendicular to the axis D of the stem 60.

The ridge portion 80 of the stem has an outer diameter that is slightly greater than the width or diameter of the opening 72 into the channel 68 defined by the flange structures 74. The outer diameter of the ridge portion 80 is less than the inner diameter of the remaining portions of the channel 68. To secure the post 58 and the stem 60 together, the ridge portion 80 of the stem 60 is aligned with the opening 72 to the channel 68 and pressed against the flange structures 74 that surround the opening 72 as depicted in FIG. 6. The ridge portion 80 causes the flange structures 74 to deflect outwardly away from the axis C of the channel to permit the ridge portion 80 of the stem 60 to pass into the channel 68. During insertion, the chamfered surface 82 of the ridge 80 engages the chamfered surfaces 78 surrounding the opening 72 into the channel to facilitate the outward deflection of the flange structures 74. To further facilitate deflection of the flange structures 74, slots 86 (FIG. 4) are defined in the post 58 that extend through the distal end portion 70 of the post and are connected to the opening 72. The slots 86 separate the flange structures 74 from each other and moves the fulcrum of the flange structures 74 away from the distal end portion 70 of the post and toward the base member 38.

Once the ridge portion 80 of the stem 60 is advanced past the flange structures 74 and into the channel 68, the narrower portion of the stem 60 permits the flange structures 74 to relax and return to their normal positions as depicted in FIG. 7. When the flange structures 74 are returned to their normal positions, the locking surfaces 76 of the flange structures 74 are positioned in front of and facing the locking surface 84 of the ridge structure 80 thereby preventing the withdrawal of the ridge portion 80 of the stem from the channel 68. By orienting the locking surfaces 76, 84 of perpendicular to the axis C of the channel 68, the resulting joint is made substantially inseparable without the use of a separate tool or without breaking one of the parts.

When the ridge portion 80 of the stem 60 is locked in the channel 68, the inner facing surface 42 of the base member 38 and the inner facing surface 46 of the cap member 36 are retained a predetermined distance E apart from each other. The distance E corresponds substantially to the height of the hole saw. The height of the hole saw corresponds to the distance between the outer surface 28 of the mounting portion 18 and the circular cutting edge 22 (FIG. 2). When an adapter 23 is attached to the hole saw, the height of the hole saw 14 corresponds to the distance between the outer surface 29 of the adapter and the cutting edge portion 22 of the hole saw (FIG. 3). When the cutting edge 22 is positioned adjacent the base member 38, the cap member 36 is held adjacent to the outer surface 28 of the mounting portion 18 so that movement of the cutting edge 22 away from the base 38 is prevented.

The hang tag assembly 10 is also configured to prevent or limit rotational movement of the hole saw 14 with respect to the cap member 36 and base member 38. Referring again to FIGS. 2, 4 and 5, the stem 60 of the cap member 36 includes ribs or splines 88 that extend along the stem 60 generally parallel to the stem axis D. The splines 88 are configured complementary to the grooves 34 defined in the bore 26. When the stem 60 is advanced through the bore 26 in the mounting portion 18, the splines 88 are received the grooves 34. Alternatively, the splines 88 can be configured to provide a friction fit within a threaded bore in the mounting portion of a hole saw.

Figure 8:
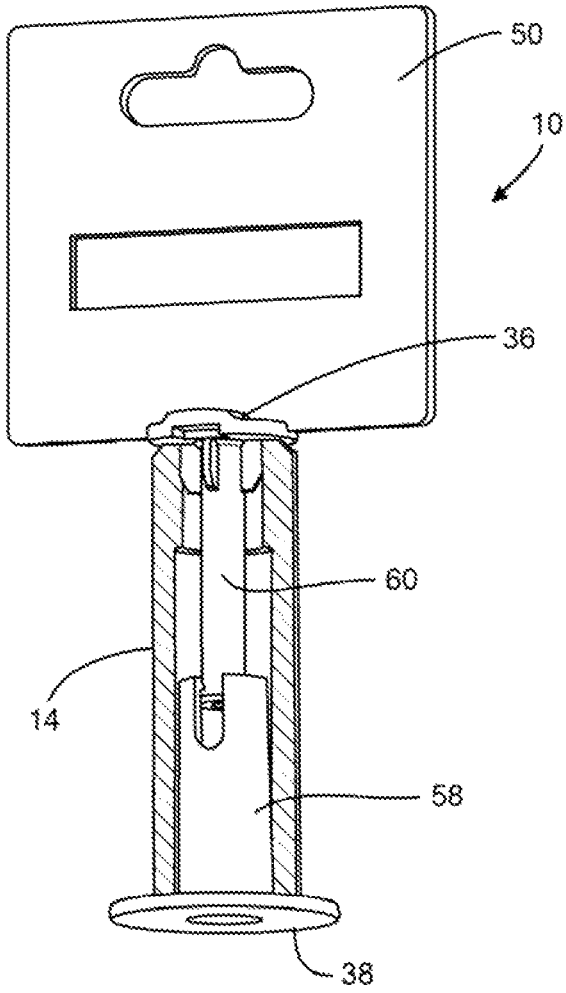
FIGS. 8-10 depict cross-sectional views of embodiments of hang tag assemblies with hole saws of various sizes.
Figure 9:
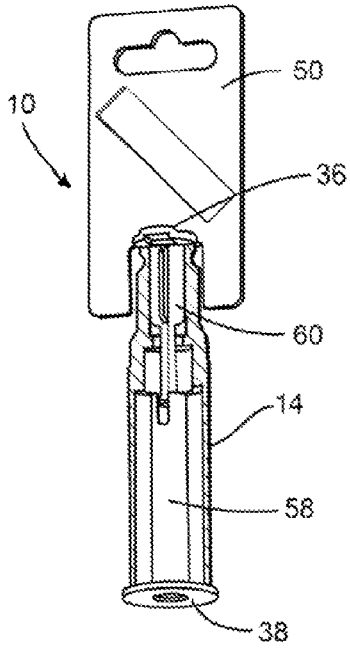
Figure 10:
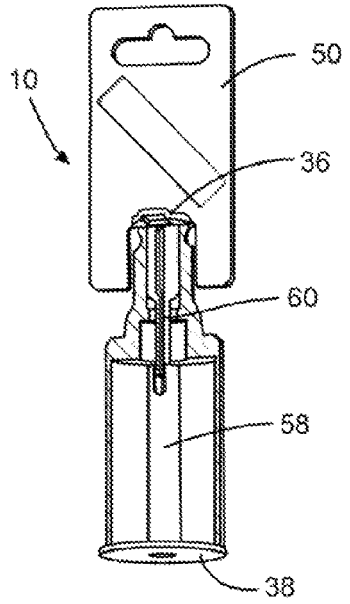

The dimensions and shapes of the base member 38, cap member 36, post 58, and stem 60 can be modified to accommodate hole saws of different heights, diameters, arbor hole diameters, and arbor hole configurations. FIGS. 8-10 show embodiments of hang tag assemblies 10 that are adapted to support and retain various sizes and types of hole saws 14.

In the embodiments of FIGS. 1-10, a single ridge portion 80 is provided on the stem which enables the hang tag assembly 10 to be used to secure hole saws of a particular height. In alternative embodiments, a plurality of ridge portions (not shown) can be provided on the stem at predetermined positions relative to the stem axis D to enable a particular hang tag assembly 10 to accommodate hole saws of varying heights. In addition, although the base member 38 has been described as having the female portion (post) and the cap member 36 as having the male portion (stem) of the snap-fit joint, the male and female portions of the snap-fit joint can be swapped so that the base member 38 includes the male portion (stem) and the cap member 36 includes the female portion (post) of the snap-fit joint.

Figure 11:
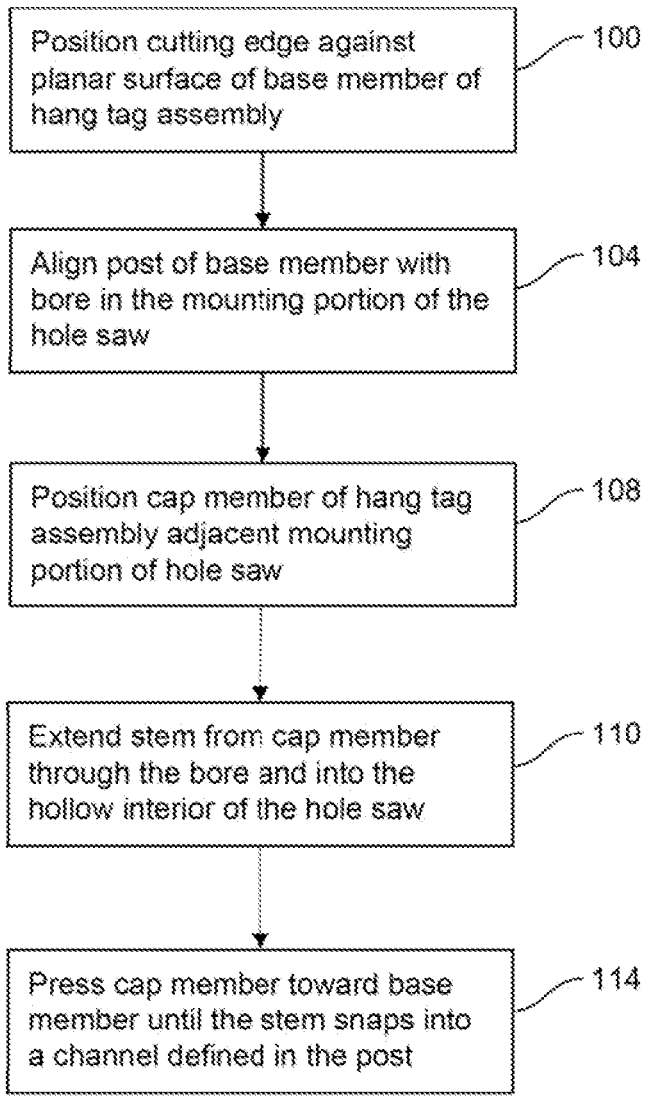
FIG. 11 is a flowchart of a method of packaging a hole saw using the hang tag assembly of FIG. 4.

A flowchart depicting a method of packaging a hole saw is shown in FIG. 11. According to the method, the circular cutting edge of the hole saw is positioned against a planar surface, i.e., the inner facing surface, of a base member of a hang tag assembly (block 100). The base member includes a post that extends from the planar surface into the hollow interior defined by the hole saw. The hole saw is positioned on the planar surface with the post aligned with the bore defined in the mounting portion of the hole saw (block 104). A cap member of the hang tag assembly is then positioned adjacent the mounting portion of the hole saw (block 108). The cap member includes a stem. The stem of the cap member is advanced through the bore and into the hollow interior of the hole saw (block 110).

The post extending from the base member includes an interior wall that defines a channel configured to receive the stem portion that extends from the cap member. The stem and the interior wall of the post are configured to have a snap-fit engagement with each other to secure the cap member to the base member. To secure the stem to the post, the cap member is pressed toward the base member until the stem snaps into place in the channel of the post (block 114). When secured together, the post and stem serve to position the cap member a predetermined distance from the base member that corresponds to the height of the hole saw.

The configuration of the hang tag assembly provides advantages over previously known packaging assemblies for hole saw. For example, the use of snap-fit type locking features enables the cap member to be locked to the base member without having to use a separate tool while making them difficult to separate the without using a separate tool or breaking one of the parts. When a hole saw is secured between the cap member and the base member as described above, the locking features of the linking structures are substantially enclosed within the hollow interior of the hole saw which further enhances security. In addition, the design of the hang tag assembly allows for nearly full exposure of the hole saw on store shelves and display racks while maintaining the cutting edge safely covered.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A method of packaging a hole saw comprising:

positioning a circular cutting edge portion of the hole saw against a surface of a base member of a hang tag assembly, the base member including a post that extends from the surface into a hollow interior defined by the hole saw;

positioning a cap member of the hang tag assembly adjacent a mounting portion of the hole saw, the cap member including a stem and a display card portion;

advancing the stem of the cap member through a bore defined in the mounting portion of the hole saw and into the hollow interior of the hole saw; and securing the post to the stem within the hollow interior of the hole saw.

2. The method of claim 1, wherein:

when the post and the stem are secured together, the cap portion is positioned a predetermined distance from the base member, the predetermined distance corresponding to a height of the hole saw.

3. The method of claim 1, wherein:

the post includes an interior wall that defines a channel and a distal end portion that defines an opening into the channel; and the stem is advanced through the opening and into the channel defined in the post.

4. The method of claim 3, wherein:

the stem is configured for snap-fit engagement with the post in the channel.

5. The method of claim 4, wherein:

the post includes flange structures that protrude into the channel from the interior wall;

the stem includes a ridge portion;

as the stem is advanced into the channel, the ridge portion of the stem deflects the flange structures outwardly to permit the ridge portion to be advanced past the flange structures in the channel; and after the ridge portion is advanced past the flange structures in the channel, the flange structures return to their normal positions to block the ridge portion from being removed from the channel.

6. A hole saw display package comprising:

a hole saw including a cylindrical body having a cutting edge portion and a mounting portion, the cylindrical body defining a hollow interior, the mounting portion including an outer surface that defines a bore for receiving an arbor of a driving tool; and a hang tag assembly including:

a base member having a surface and a first linking structure that extends from the surface;

a cap member having an inner surface and a second linking structure that extends from the inner surface; and a display card portion attached to said cap member;

wherein:

said cutting edge portion of said hole saw is positioned against said surface of said base member;

said inner surface of said cap member is positioned adjacent said outer surface of said mounting portion;

said second linking structure extends through said bore defined in said outer surface and into said hollow interior of said hole saw; and said first linking structure is secured to said second linking structure within said hollow interior to affix said cap member to said base member.

7. The assembly of claim 6, wherein:

said first linking structure and said second linking structure retain said surface of said base member and said inner surface of said cap member a predetermined distance apart from each other, said predetermined distance corresponding to a distance between said cutting edge portion and said outer surface of said mounting portion of said hole saw.

8. The assembly of claim 6, wherein:

said first linking structure and said second linking structure are configured for snap-fit engagement with each other to secure said first linking structure to said second linking structure.

9. The assembly of claim 8, wherein:

said first linking structure comprises a post that defines a channel; and said second linking structure comprises a stem that is received in said channel.

10. The assembly of claim 6, wherein:

said hang tag assembly includes a security device.

11. The assembly of claim 6, wherein:

said surface of said base member overlaps said cutting edge portion of said hole saw.

12. A hang tag assembly for a hole saw comprising:

a base member including a surface and a first linking structure that extends from said surface;

a cap member including an inner surface and a second linking structure that extends from said inner surface, and a display card portion attached to said cap member, said display card portion defining a hanging slot;

wherein:

said first linking structure and said second linking structure are configured to be secured to each other to affix said cap member to said base member;

said planar surface of said base member is configured to be placed against a circular cutting edge portion of a hole saw;

said inner surface of said cap member is configured to be positioned adjacent a mounting portion of the hole saw;

said second linking structure is configured to extend through a bore defined by the mounting portion when said inner surface is positioned adjacent the mounting portion of the hole saw; and when said surface of said base member is positioned adjacent the cutting edge portion of the hole saw and said inner surface of said cap member is positioned adjacent the mounting portion of the hole saw with said second locking structure extended through the bore, said first linking structure and said second linking structure are configured to meet within a hollow interior defined in the hole saw.

13. The hang tag assembly of claim 12, wherein:

said first linking structure and said second linking structure are configured to be secured to each other within the hollow interior of the hole saw.

14. The hang tag assembly of claim 12, further comprising:

a security device attached to said display card portion.

15. The hang tag assembly of claim 12, wherein:

said surface of said base member has a circular shape that is configured to overlap the circular cutting edge portion of the hole saw.

16. The hang tag assembly of claim 12, wherein:

when said first linking structure and said second linking structure are secured together, said inner surface of said cap member is retained a predetermined distance from said surface of said base member, said predetermined distance corresponding to a height of the hole saw.

* * * * *